US005624541A

United States Patent [19]

Pohmer et al.

[11] Patent Number: 5,624,541

[45] Date of Patent: Apr. 29, 1997

[54] SPRAY MIST INHIBITORS FOR BASIC ELECTROLYSIS BATHS

[75] Inventors: Klaus Pohmer; Hans-Bernd Alteweier; Karl-Heinz Stachulla, all of Leverkusen, Germany

[73] Assignee: Bayer Aktiengesellschaft, Leverkusen, Germany

[21] Appl. No.: 530,997

[22] Filed: Sep. 20, 1995

[30] Foreign Application Priority Data

Oct. 7, 1994 [DE] Germany ..... 44 35 840.7

[51] Int. Cl.[6] ..... C25D 21/11

[52] U.S. Cl. ..... 205/94; 205/52; 205/82

[58] Field of Search ..... 205/52, 82, 94; 252/32, 33; 568/28; 564/80, 95, 96

[56] References Cited

U.S. PATENT DOCUMENTS 2,750,336 6/1956 Brown ..... 204/51

3,917,691 11/1975 Ray-Chaudhuri ..... 250/556 F

FOREIGN PATENT DOCUMENTS 0299307 1/1989 European Pat. Off. .

OTHER PUBLICATIONS

Tijdschrift Voor Oppervlaktetechnieken van Materialen, Bd. 28, Nr. 8 (Aug., 1994) pp. 214–220.

Protection of Metals, Bd. 27, Nr. 2 (Mar., 1991) pp. 266–268.

H. Niederprüm, Seifen–Öle–Fette–Wachse (1978), pp. 429–432 No Month Available.

J.N. Meussdoerffer et al., Chemikerzeitung 104 (1980) pp. 45–52 No Month Available.

von H.G. Klein et al., Tenside Detergents (1978) pp. 2–6 No Month Available.

E. Kissa, Fluorinates Surfactants: Synthesis–Properties–Applications, Surfactants Science 50:332 (1992) No Month Available.

E. Kissa, Fluorinates Surfactants: Synthesis–Properties–Applications, Surfactants Science 50:56 (1994) No Month Available.

*Primary Examiner*—Kathryn Gorgos
*Assistant Examiner*—Alexander Noguerola
*Attorney, Agent, or Firm*—Connolly and Hutz

[57] ABSTRACT

This invention relates to the use of spray mist inhibitors in basic electrolysis bath processes.

7 Claims, No Drawings

SPRAY MIST INHIBITORS FOR BASIC ELECTROLYSIS BATHS

This invention relates to the use of spray mist inhibitors in basic electrolysis bath processes.

Gases are formed in many electrolytic bath processes. In some cases, these gases are formed as intended reaction products at the electrodes. In other cases, the electrolysis processes do not take place with complete current efficiency through overvoltage so that gases are formed as secondary products. For example, the electrolysis of water often takes place as a competitive reaction in water-based processes, giving oxygen and hydrogen as products.

The gases formed quickly rise as bubbles to the surface of the electrolyte where they burst. The bubble walls collapse and form a so-called jet which shoots out from the liquid surface. This jet rapidly breaks up into individual droplets which are projected into the atmosphere at a speed of up to 10 m/s. This process is responsible for the formation of spray mists.

By adding a surfactant, the surface tension in the electrolyte is reduced from around 70 mN/m to less than 40 mN/m. Fluorinated surfactants in particular are used by virtue of their high chemical and thermal stability. The compounds used are, for example, perfluoroalkyl sulfonates (H. Niederprüm, Seifen-Öle-Fette-Wachse (1978), 429–432; J. N. Meuβdoerffer, H. Niederprüm, Chemikerzeitung 104 (1980), 45–52; H. G. Klein, J. N. Meuβdoerffer, H. Niederprüm, M. Wechsberg, Tenside Surfactants Detergents 15 (1978), 2–6), such as for example $[C_8F_{17}SO_3]K$ and $[C_8F_{17}SO_3][N(C_2H_5)_4]$.

The effect of reducing surface tension is that the ascending gas bubbles are greatly reduced in size and ascend more slowly than large bubbles. The more slowly the bubbles ascend, the lower their kinetic energy. The energy released when the bubble walls burst is also greatly reduced with decreasing surface tension; jet formation is virtually prevented. If, nevertheless, jets are formed, they have such a low energy content that the droplets formed from them generally fall back onto the surface of the bath.

The addition of a surfactant ensures that the atmosphere, particularly in the workplace itself, remains clean, the load on the gas cleaning systems is clearly relieved, the energy consumed in extraction can be reduced and, above all, the losses of electrolyte through drag-out are reduced.

The fluorinated surfactants used in the past (E. Kissa, Fluorinates Surfactants: Synthesis-Properties-Applications, Surfactants Science Series 50 (1994), 332) only prevent spray mists in acidic electrolysis bath processes (for example electrolytic chromium plating). In basic electrolysis baths, such as for example metallizing baths (for example basic zinc plating), demetallizing baths (for example basic dechroming), browning baths and degreasing baths, the known compounds are ineffectual.

Accordingly, the problem addressed by the present invention was to provide a spray mist inhibitor for basic electrolysis bath processes which would function in highly basic media, even at elevated temperatures.

This problem has been solved by the provision of perfluoroalkylsulfonamides as spray mist inhibitors for basic electrolysis baths.

The perfluoroalkylsulfonamides used in accordance with the invention surprisingly prevent the formation of spray mists without being decomposed at relatively high temperatures in the basic electrolyte.

The present invention relates to spray mist inhibitors for basic electrolysis baths consisting of alkyl-substituted perfluoroalkylsulfonamides corresponding to formula (I):

$$R_FSO_2NHCH_3 \quad (I)$$

where $R_F$ is a perfluoroalkyl group containing 4 to 10 carbon atoms, which are used in a quantity of 50 to 250 mg per liter of basic electrolyte.

The compounds corresponding to formula (I) are preferably alkyl-substituted perfluoroalkylsulfonamides in which $R_F$ is a perfluoroalkyl radical containing 6 to 8 carbon atoms.

The spray mist inhibitors are preferably used in a quantity of 100 to 200 mg per liter of basic electrolyte.

The production of the alkyl-substituted perfluoroalkylsulfonamides is described in detail in the literature (E. Kissa, Fluorinates Surfactants: Synthesis-Properties-Applications, Surfactant Science Series 50 (1994) 56).

The invention is illustrated by the following Examples.

Example

All surface tensions were measured with a Lauda type TE 1C ring tensiometer.

Example 1

70 mg of N-methyl perfluorooctyl sulfonamide are added to 700 ml of aqueous sodium hydroxide solution (concentration: 20% by weight of sodium hydroxide) in a glass beaker (V=1,000 ml). The surface tension of this solution (T=55° C.) is 22 mN/m.

The solution is electrolyzed (cathode: steel plate, anode: steel cylinder with an approx. 100 μm thick chromium layer, current density: 15 A/dm$^2$, temperature T=30° C.).

About every 20 minutes, a filter paper impregnated with phenolphthalein is held about 5 cm above the electrolysis bath for about 2 minutes.

After 20 minutes: no coloration

After 40 minutes: no coloration.

No spray mists occur.

Example 2

70 mg of N-methyl perfluorooctyl sulfonamide are added to 700 ml of aqueous sodium hydroxide solution (concentration: 20% by weight of sodium hydroxide) in a glass beaker (V=1,000 ml). The surface tension of this solution (T=55° C.) is 22 mN/m.

The solution is electrolyzed (cathode: steel plate, anode: steel cylinder with an approx. 100 μm thick chromium layer, current density: 15 A/dm$^2$, temperature T=55° C.).

About every 20 minutes, a filter paper impregnated with phenolphthalein is held about 5 cm above the electrolysis bath for about 2 minutes.

After 20 minutes: no coloration

After 40 minutes: no coloration.

No spray mists occur.

Example 3

70 mg of N-methyl perfluorooctyl sulfonamide are added to 700 ml of aqueous sodium hydroxide solution (concentration: 20% by weight of sodium. hydroxide) in a glass beaker (V=1,000 ml). The surface tension of this solution (T=55° C.) is 22 mN/m.

The solution is electrolyzed (cathode: steel plate, anode: steel cylinder with an approx. 100 μm thick chromium layer, current density: 15 A/dm$^2$, temperature T=90° C.).

About every 20 minutes, a filter paper impregnated with phenolphthalein is held about 5 cm above the electrolysis bath for about 2 minutes.

After 20 minutes: no coloration

After 40 minutes: no coloration.

No spray mists occur.

Example 4

140 mg of N-methyl perfluorobutyl sulfonamide are added to 700 ml of aqueous sodium hydroxide solution (concentration: 20% by weight of sodium hydroxide) in a glass beaker (V=1,000 ml). The surface tension of this solution (T=55° C.) is 33 mN/m.

The solution is electrolyzed (cathode: steel plate, anode: steel cylinder with an approx. 100 μm thick chromium layer, current density: 15 A/dm$^2$, temperature T=30° C.).

About every 20 minutes, a filter paper impregnated with phenolphthalein is held about 5 cm above the electrolysis bath for about 2 minutes.

After 20 minutes: no coloration

After 40 minutes: no coloration.

No spray mists occur.

Example 5

70 mg of N-methyl perfluorohexyl sulfonamide are added to 700 ml of aqueous sodium hydroxide solution (concentration: 20% by weight of sodium hydroxide) in a glass beaker (V=1,000 ml). The surface tension of this solution (T=55° C.) is 18 mN/m.

The solution is electrolyzed (cathode: steel plate, anode: steel cylinder with an approx. 100 μm thick chromium layer, current density: 15 A/dm$^2$, temperature T=55° C.).

About every 20 minutes, a filter paper impregnated with phenolphthalein is held about 5 cm above the electrolysis bath for about 2 minutes.

After 20 minutes: no coloration

After 40 minutes: no coloration.

No spray mists occur.

Example 6

100 mg of N-methyl perfluorooctyl sulfonamide are added to 900 ml of aqueous sodium hydroxide solution (concentration: 20% by weight of sodium hydroxide) in a glass beaker (V=1,000 ml). The surface tension of this solution (T=55° C.) is 17 mN/m.

The solution is electrolyzed (cathode: steel plate 0.45 dm$^2$, anode: steel plate 0.45 dm$^2$, current density: 10 A/dm$^2$, temperature T=55° C.).

About every 20 minutes, a filter paper impregnated with phenolphthalein is held about 5 cm above the electrolysis bath for about 2 minutes.

After 20 minutes: no coloration

After 40 minutes: no coloration.

No spray mists occur.

Comparison Example 7

A glass beaker (V=1,000 ml) is filled with 700 ml of aqueous sodium hydroxide solution (concentration: 20% by weight of sodium hydroxide). The surface tension of this solution (T=55° C.) is 55 mN/m.

The solution is electrolyzed (cathode: steel plate, anode: steel cylinder with an approx. 100 μm thick chromium layer, current density: 15 A/dm$^2$, temperature T=30° C.).

About every 20 minutes, a filter paper impregnated with phenolphthalein is held about 5 cm above the electrolysis bath for about 2 minutes.

After 20 minutes: pink coloration

After 40 minutes: pink coloration.

Dense spray mists occur.

Comparison Example 8

200 g of tetraethyl ammonium perfluorooctane sulfonate are added to 700 ml of aqueous sodium hydroxide solution (concentration: 20% by weight of sodium hydroxide) in a glass beaker (V=1,000 ml). The surface tension of this solution (T=55° C.) is 21 mN/m.

The solution is electrolyzed (cathode: steel plate, anode: steel cylinder with an approx. 100 μm thick chromium layer, current density: 15 A/dm$^2$, temperature T=30° C.).

About every 20 minutes, a filter paper impregnated with phenolphthalein is held about 5 cm above the electrolysis bath for about 2 minutes.

After 20 minutes: pink coloration

After 40 minutes: pink coloration.

Dense spray mists occur.

Comparison Example 9

A glass beaker (V=1,000 ml) is filled with 900 ml of aqueous sodium hydroxide solution (concentration: 15% by weight of sodium hydroxide). The surface tension of this solution (T=55° C.) is 59 mN/m. The solution is electrolyzed (cathode: steel plate 0.45 dm$^2$, anode: steel plate 0.45 dm$^2$, current density: 10 A/dm$^2$, temperature T=55° C.). About every 20 minutes, a filter paper impregnated with phenolphthalein is held about 5 cm above the electrolysis bath for about 2 minutes.

After 20 minutes: pink coloration

After 40 minutes: pink coloration.

Spray mists occur.

What is claimed is:

1. A basic electrolyte bath comprising a basic electrolyte and 50 to 250 mg per liter of electrolyte of a methyl-substituted perfluoroalkylsulfonamide of the formula (I)

$$R_FSO_2NHCH_3 \quad (I)$$

where $R_F$ is a perfluoroalkyl group containing 4–10 carbon atoms.

2. The bath as claimed in claim 1, wherein $R_F$ is a perfluoroalkyl group containing 6–8 carbon atoms.

3. The bath as claimed in claim 1, wherein the bath is a metallizing bath.

4. The bath as claimed in claim 1, wherein the bath is a demetallizing bath.

5. The bath as claimed in claim 1, wherein the bath is a browning bath.

6. The bath as claimed in claim 1, wherein the bath is a degreasing bath.

7. The bath as claimed in claim 1, wherein the basic electrolyte is aqueous sodium hydroxide.

* * * * *